US006568103B2

(12) United States Patent
Durocher

(10) Patent No.: US 6,568,103 B2
(45) Date of Patent: May 27, 2003

(54) SPEED LACING DEVICE

(75) Inventor: Jacques Durocher, St-Jérôme (CA)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/791,694

(22) Filed: Feb. 26, 2001

(65) Prior Publication Data

US 2002/0083619 A1 Jul. 4, 2002

(30) Foreign Application Priority Data

Dec. 28, 2000 (CA) ..... 2329692

(51) Int. Cl.[7] ..... A43C 11/00

(52) U.S. Cl. ..... 36/50.1; 36/50.5; 24/713.6; 24/712.1

(58) Field of Search ..... 36/50.1, 50.5, 36/115; 24/713.6, 712.1, 713.9, 714.8

(56) References Cited

U.S. PATENT DOCUMENTS 1,019,024 A * 3/1912 Clark ..... 24/713.9
1,242,774 A 10/1917 Curry
1,246,724 A 11/1917 Daggett
1,282,539 A 10/1918 Carlson
1,292,975 A 1/1919 Valade
1,412,486 A * 4/1922 Paine ..... 24/713.4
1,429,657 A 9/1922 Trawinski
1,466,673 A * 9/1923 Solomon et al. ..... 24/713.3
1,469,661 A * 10/1923 Migita ..... 24/712.1
3,793,749 A * 2/1974 Gertsch et al. ..... 36/117.6
4,633,548 A 1/1987 Siskind et al.
5,158,428 A * 10/1992 Gessner et al. ..... 24/712.1
5,566,474 A * 10/1996 Leick et al. ..... 24/713.1
5,761,777 A * 6/1998 Leick ..... 24/713.5
5,906,057 A 5/1999 Borsoi
6,029,375 A 2/2000 Borel

* cited by examiner

*Primary Examiner*—Mickey Yu
*Assistant Examiner*—Troy Arnold

(57) ABSTRACT

A speed lacing device for an article of footwear having a rigid portion comprising a curved neck and a fastening tail that together define an almost-friction-free sliding surface for a lacing cord, the lacing cord being in contact with the sliding surface in either a state of tension or a state of relaxation. The speed lacing device also having a flexible portion that extends from the rigid portion to form an upper half of a closed loop through which the lacing cord is threaded.

36 Claims, 4 Drawing Sheets

SPEED LACING DEVICE

FIELD OF THE INVENTION

The present invention relates to the field of lacing devices and more specifically to a speed lacing device for an article of athletic footwear that, combined with a tightening device such as a lacing cord, enables quick and easy placement and tightening of an article of athletic footwear, on a wearer's foot.

BACKGROUND OF THE INVENTION

A common problem with lacing devices of the prior art is that they often inflict unnecessary friction on the lacing cords. One such lacing device is the basic lacing eyelet found in the upper of many articles of athletic footwear. Lacing eyelets force the lacing cords to be threaded between two horizontal planes, one above the side walls of the upper and one below the side walls of the upper, and force the lacing cords to change direction by 180 degrees over a very thin surface. This sharp change in direction around the lip of the eyelets causes excessive rubbing, and therefore reduces the life-span of the lacing cord.

Obviously if there is excessive friction on the lacing cord, not only will the lacing cord suffer unnecessary wear, but the article of footwear will be more difficult to tighten and undo. Many of the lacing devices described in the prior art require that the wearer tighten the lacing cord at each individual lacing device because there is too much friction between the lacing cord and the lacing devices to be able to tighten the article of footwear with just one pull.

It is also common in the prior art to have lacing devices that are attached to the footwear upper by creating a hole in the upper and attaching the lacing device through the hole. U.S. Pat. No. 4,633,548 describes such a lacing device that includes a rigid loop portion through which the lacing cord is inserted, and a rivet that secures the lacing device to the footwear through a hole in the upper. The rigid loop portion has a series of gripping teeth to ensure that the lacing device is fixed in place. While this method gives a secure attachment, it is time consuming to install and the hole creates a weakness in the fabric of the upper.

U.S. Pat. No. 5,906,057 discloses a lacing device that comprises a flexible loop and a stiff guiding element that is threaded onto the flexible loop. The guiding element is made of plastic and substantially reduces the friction between the lacing cord and the lacing device. While this lacing device reduces friction, a disadvantage is that the guiding element is free to move about on the flexible loop. This means that the guiding element can move out of engagement with the lacing cord causing the lacing cord to interfere with the flexible loop. A second disadvantage of this lacing device is that the guiding element is only in contact with the lacing cord when the lacing cord is under tension. When the boot is being loosened, the lacing cord loses contact with the smooth guide path of the guiding element and falls onto the flexible loop which generates significant friction on the lacing cord. When the boot is re-tightened, there is the possibility that the lacing cord may not engage the guiding element properly, thereby adding friction to the lacing cord and defeating the purpose of the guiding element.

Based on the prior art, an improved lacing device is needed that can reduce the amount of frictional wear on the lacing cord by providing a smooth surface for the lacing cord to slide along both when it in a state of tension and a state of relaxation. Also, a lacing device is needed that can be securely fastened to a footwear upper without creating a hole in the upper fabric.

SUMMARY OF THE INVENTION

A general object of the present invention is to provide an improved lacing device comprising an almost-friction-free sliding surface adapted to receive lacing cords.

A more specific object of the present invention is to provide an improved lacing device with an almost-friction-free surface adapted to receive lacing cords so that the lacing cord may contact the almost-friction-free surface when it is in both a state of tension and relaxation, in order to reduce lacing resistance and increase the life-span of the lacing cord.

Another specific object of the invention is to provide a strong, rigid and long-wearing lacing device that is adapted to be securely fastened to a footwear upper without the need for creating a hole in the surface of the upper fabric.

As embodied and broadly described herein, the invention provides an improved speed lacing device for an article of footwear, said lacing device comprising:

- a rigid J-shaped element adapted to be securely fastened at one end to a quarter of a footwear upper, said J-shaped element comprising a curved neck portion and a fastening tail that together define an almost-friction-free sliding surface for a lacing cord, said lacing cord being in contact with said sliding surface in either a state of tension or a state of relaxation;
- a flexible strap that combined with the J-shaped element forms a closed loop through which said lacing cord is threaded, said strap being securely fastened at both ends to a quarter of the footwear upper;
- said rigid J-shaped element and said strap together defining a lacing-cord-passageway adapted to receive a lacing cord for tightening said article of footwear around the wearer's foot.

As embodied and broadly described herein, the invention also provides an article of footwear that comprises:

- An upper that extends upwardly from the base of the wearer's foot and comprises two quarters that are separated by an opening at the frontal part of the upper for allowing placement of the footwear on the wearer's foot.
- A series of lacing devices that are attached in rows along the edge of the opening between the two quarters, the rows being positioned in pairs opposite each another, said lacing devices comprising:
  - a) a rigid J-shaped element adapted to be securely fastened at one end to a quarter of a footwear upper, said J-shaped element comprising a curved neck portion and a fastening tail that together define an almost-friction-free sliding surface for a lacing cord, said lacing cord being in contact with said sliding surface in either a state of tension or a state of relaxation;
  - b) a flexible strap that combined with the J-shaped element forms a closed loop through which said lacing cord is threaded, said strap adapted to be securely fastened to a quarter of a footwear upper;
  - c) said rigid J-shaped element and said strap together defining a lacing cord passageway adapted to receive a lacing cord for tightening said article of footwear around the wearer's foot.

As embodied and broadly described herein, the invention also provides a speed lacing device for an article of footwear, said lacing device comprising:

A J-shaped element, said J-shaped element comprising a curved neck portion and a fastening tail adapted to be securely fastened to a quarter of a footwear upper;

A strap extending around said J-shaped element for forming therewith a closed loop for receiving a lacing cord, said strap being adapted to sandwich the fastening tail and be securely fastened to a quarter of a footwear upper.

DETAILED DESCRIPTION

Figure 1:
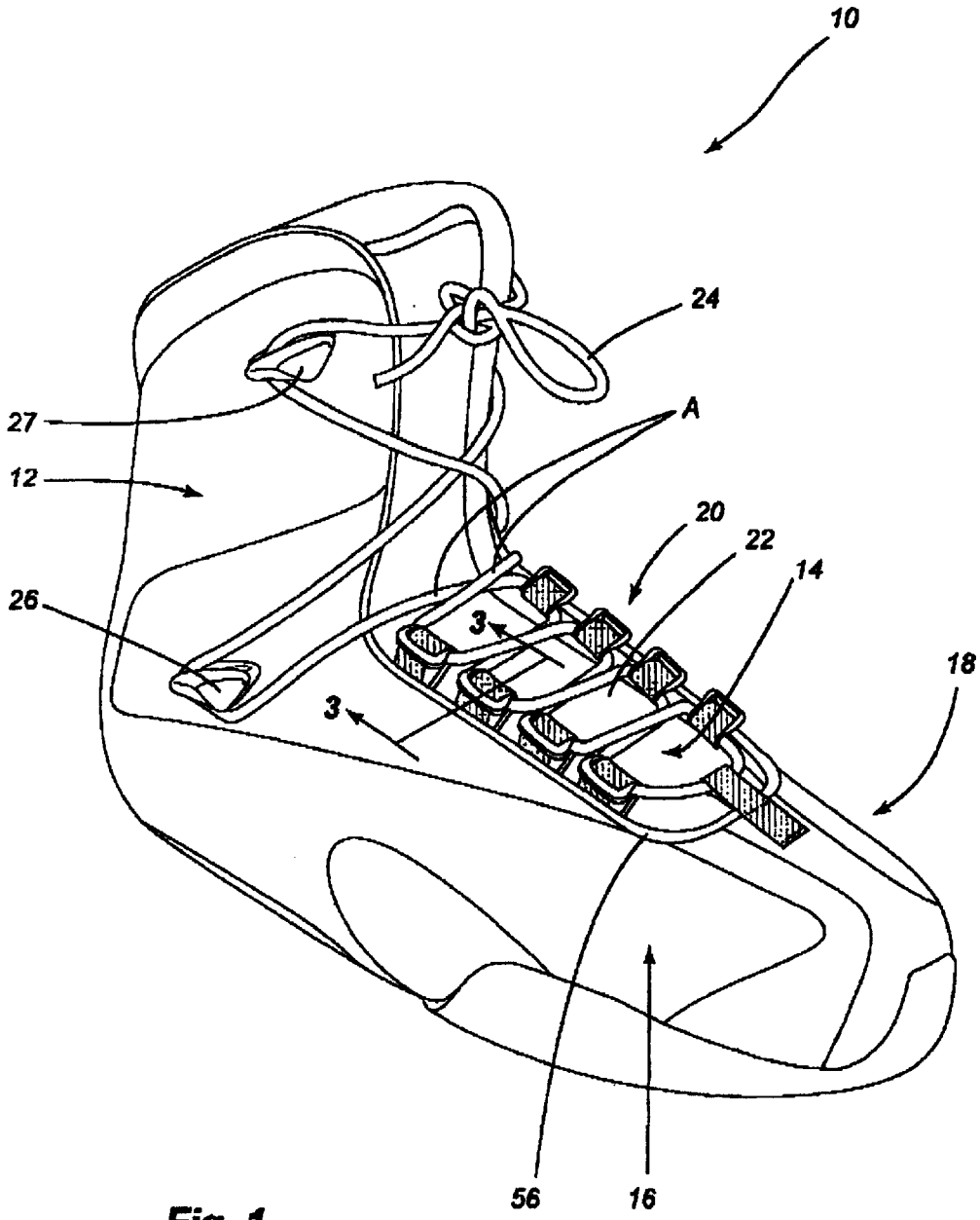
FIG. 1 is a perspective view of an article of athletic footwear tightened up with the lacing device and a lacing cord according to the invention.

FIG. 1 shows an article of athletic footwear that comprises a series of lacing devices 20 according to the present invention. In this embodiment of the invention the article of athletic footwear is an in-line skate boot 10. Boot 10 is made of an upper 12 that extends up from the bottom of boot 10 and covers the back and sides of the wearer's foot, as well as the back and sides of the wearer's ankle.

Upper 12 is open at the front of boot 10 revealing an opening 14 that is surrounded by a left quarter 16 and a right quarter 18. A tongue 22 is attached to boot 10 at the base of opening 14, and extends from there up to the top of opening 14 in order to cover the frontal portion of the wearer's foot and ankle. Tongue 22 is hinged at the base of opening 14 and flaps forward in order to allow the insertion and withdrawal of the wearer's foot inside upper 12.

As can be seen in FIG. 1, the series of lacing devices 20 are arranged in rows along the edge of quarters 16 and 18. They are positioned in pairs opposite each other on either side of opening 14 in order to define the criss-cross, horizontal path followed by lacing cord 24. As lacing cord 24 is pulled, quarters 16 and 18 move in towards the center of opening 14, causing boot 10 to tighten around the wearer's foot.

In a preferred embodiment of the invention, lacing cord 24 is pulled by the wearer at the position just above the series of lacing devices 20, indicated by location A in FIG. 1. The wearer must only pull lacing cord 24 once, instead of at each individual lacing device 20, in order to tighten boot 10. The array of lacing devices provides an almost-friction-free lacing path enabling the wearer to efficiently tighten lacing cord 24 with a single pulling action. Once boot 10 has been tightened, the wearer inserts lacing cord 24 into anchor hooks 26 and 27 located on the ankle of boot 10 in order to prevent lacing cord 24 from coming undone.

Figure 2:
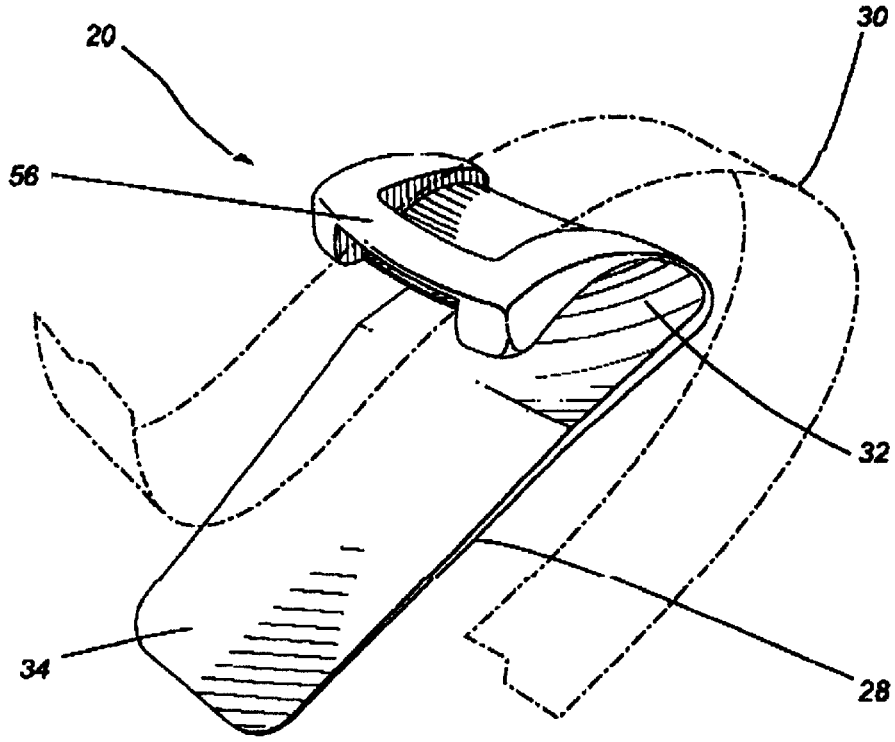
FIG. 2 is a perspective view of the lacing device showing the J-shaped element and the strap.

As shown in FIG. 2, each lacing device 20 comprises a J-shaped element 28 and a strap 30. Strap 30 is made of a strong, flexible, long-wearing material such as Nylon fiber and gives lacing device 20 an aesthetically pleasing look, making boot 10 more attractive.

J-shaped element 28 is made of a strong, rigid, material such as plastic, that comprises two distinct parts, namely a curved neck portion 32 that will be described in detail further on, and a fastening tail 34. Fastening tail 34 is a flat, smooth surface that is tapered to form a thin edge at its end. The thin tapered edge, and flat smooth surface of fastening tail 34 makes it easy to insert between two layers of fabric 58 that make up upper 12. Once fastening tail 34 has been inserted into its correct position, it is secured to upper 12 by stitches 46. The stitches 46 secure fastening tail 34 to the upper and maintain it in its proper position regardless of whether lacing cord 24 is being pulled or not. The stitches 46 further prevent fastening tail 34 from moving in a side to side movement. Fastening tail 34 is designed to be of a thickness and material that is thin enough to be attached by stitching 46, but thick enough to be securely anchored to footwear upper 12 without tearing off during tightening.

Figure 5:
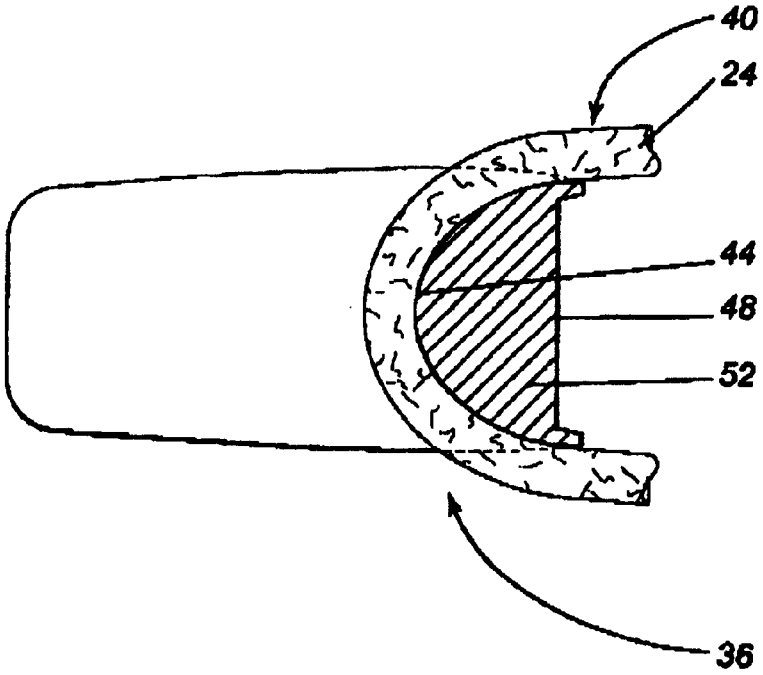
FIG. 5 is a top plan view of the section along line 5—5 of FIG. 4 showing the path of a lace therethrough.
Figure 6:
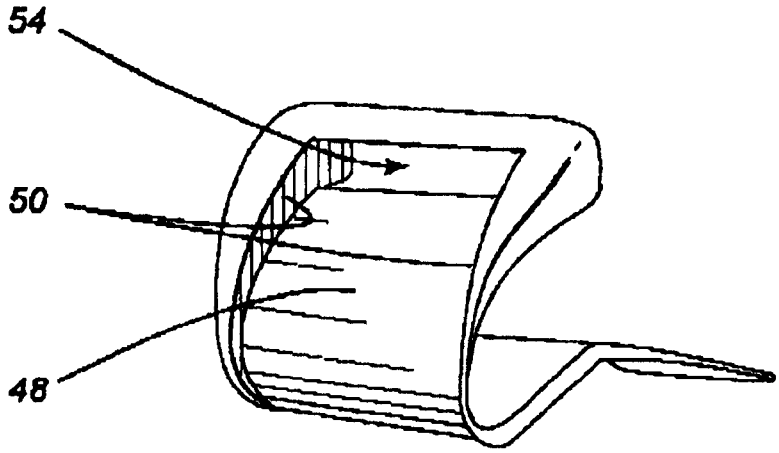
FIG. 6 is a perspective view of the back of the J-shaped element.
Figure 7:
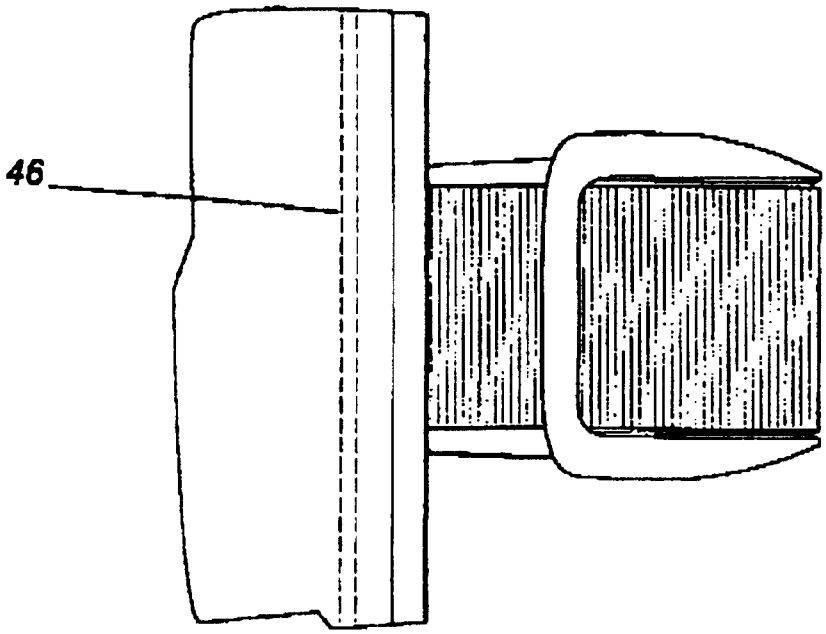
FIG. 7 is a top view of the lacing device sewn into the upper of a footwear.

Curved neck portion 32 of J-shaped element 28 is a complicated shape. It is formed in the shape of a hook, and when fastening tail 34 is secured to upper 12, the hook faces away from the center of boot 10. As can be seen in FIG. 5 and 6, a guidepath 48 runs along the back of curved neck portion 32 and is made up of a rounded surface surrounded by two walls 50. As can be seen in FIG. 5, the inside of curved neck portion 32 is a semi-circular surface 44 that defines a convex, rounded path for lacing cord 24. Semi-circular surface 44 guides lacing cord 24 during the tightening of boot 10. In a preferred embodiment the area in between semicircular surface 44 and guidepath 48 is made of a solid material 52 giving curved neck portion 32 more strength when lacing cord 24 is being pulled. In an alternative embodiment, the area in between semi-circular surface 44 and guidepath 48 can be hollow in order to create a lighter-weight lacing device 20.

The purpose of guidepath 48 is to maintain strap 30 in its proper position so that it does not slip out of place and interfere with lacing cord 24. Walls 50 surround guidepath 48 and limit the side-to-side movement of strap 30. Strap 30 is further maintained in place by a strap-passageway 54 that marks the end of the surface contact between strap 30 and J-shaped element 28. In a preferred embodiment as seen in FIG. 5 strap-passageway 54 is formed by two walls 50 and a bridge 56 that extends between the two walls 50 over the surface of guidepath 48. Bridge 56 gives an element of style to lacing device 20 while ensuring that strap 30 can not slip over walls 50.

As described above curved neck portion 32 of J-shaped element 28, comprises a peripheral convex semi-circular surface 44. The diameter of semi-circular surface 44 is equal to the depth of J-shaped element 28 so that there are no discontinuities in the circular path that could create wear on lacing cord 24. Semi-circular surface 44 also allows lacing cord 24 to change direction in a smooth manner without having to go around any sharp corners or edges that could cause excessive friction and wear.

Figure 3:
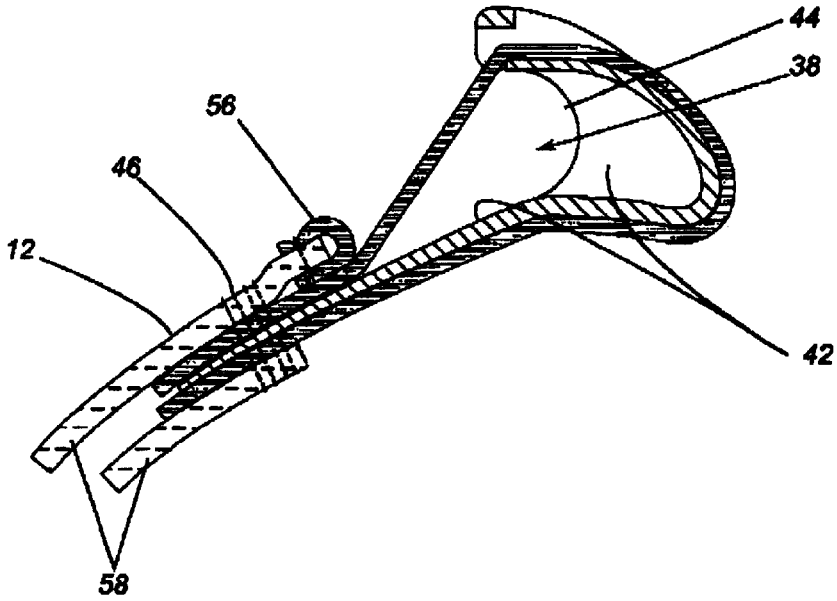
FIG. 3 is a cross sectional view of the lacing device taken at line 3—3 of FIG. 1, the lacing device is shown in its attached position to the upper of the footwear.
Figure 4:
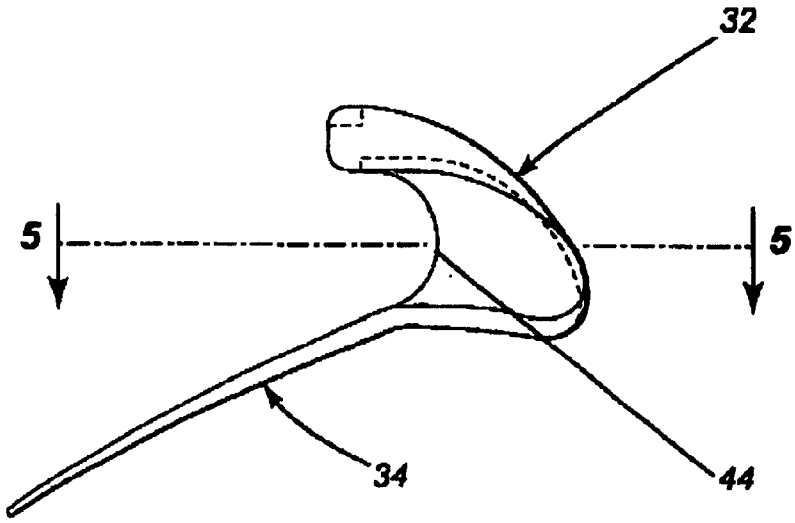
FIG. 4 is a side view of the J-shaped element of the lacing device.

As shown in FIG. 3, when strap 30 is combined with J-shaped element 28, the two parts form a closed loop that creates a lacing-cord-passageway 38 for receiving lacing cord 24. With reference to FIGS. 3 to 5, lacing cord 24 enters lacing-cord-passageway 38 at entrance 36 and passes through to exit 40. Within lacing-cord-passageway 38 is a smooth sliding surface 42 for lacing cord 24 to slide along. Sliding surface 42 comprises two distinct areas, semicircular surface 44 and the top surface of fastening tail 34. Each of these areas comes in contact with lacing cord 24 when lacing cord 24 is in different states. When lacing cord 24 is in a state of tension during the tightening of boot 10, lacing cord 24 slides against semi-circular surface 44. And when lacing cord 24 is in a state of relaxation, lacing cord 24 loses contact with semi circular surface 44 and drops down to slide against the top surface of fastening tail 34. As can be seen in FIG. 3, a portion of fastening tail 34 juts out from upper 12 to provide a sliding surface for lacing cord 24. Sliding surface 42 includes a flat portion of fastening tail 34 that allows lacing cord 24 to be in contact with a smooth, almost-friction-free surface at all times and not just when lacing cord 24 is in a state of tension.

In FIG. 3 it can be seen that strap 30 is wrapped lengthwise around J-shaped element 28. The closed loop that forms lacing-cord passageway 38 is created by positioning strap 30 so that it runs along the bottom of fastening tail 34. From there, strap 30 runs along the outside-back of curved neck portion 32 inside guidepath 48, and then runs through strap-passageway 54 down to the top of fastening tail 34. The end result is that fastening tail 34 is sandwiched between two ends of strap 30. This sandwiched combination of the two ends of strap 30 and fastening tail 34 are then securely stitched between two layers of upper 12.

As can be seen in FIG. 3 and FIG. 8 there are rows of stitches 46 across the depth of fastening tail 34 and strap 30 in order to attach them to upper 12. The stitching is perpendicular to the direction of extension of J-shaped element 28 in order to give lacing device 20 the stability it needs so that it does not rotate when lacing cord 24 is being pulled. Stitches 46 provide a strong, secure attachment of lacing device 20 to upper 12 without puncturing a hole in the fabric of upper 12.

As shown in FIG. 3, lining the edges of quarters 16 and 18 is a peripheral lip 56 that is attached, by sewing or other method, onto upper 12. This peripheral lip 56 reduces the frictional wear on strap 30 ensuring that the rubbing of quarters 16 and 18 on strap 30 does not cause strap 30 to break.

The above description of preferred embodiments should not be interpreted in a limiting manner since other variations, modifications and refinements are possible within the spirit and scope of the present invention. The scope of the invention is defined in the appended claims and their equivalents.

I claim:

1. A speed lacing device comprising:

(a) a rigid J-shaped element adapted to be securely fastened at one end to a quarter of a footwear, said J-shaped element comprising a curved neck portion and a fastening tail that together define an almost-friction-free sliding surface, and a lacing cord in contact with said almost-friction-free sliding surface in either a state of tension or a state of relaxation;

(b) a flexible strap that combined with said J-shaped element forms a closed loop for receiving the lacing cord, said strap being adapted to be fastened at both ends to a quarter of a footwear; and (c) said rigid J-shaped element and said strap together defining a lacing-cord-passageway adapted to receive the lacing cord for tightening a footwear around a wearer's foot.

2. A speed lacing device as defined in claim 1, wherein said almost-friction-free sliding surface comprises a first sliding surface portion provided on said curved neck portion and a second sliding surface portion provided on said fastening tail.

3. A speed lacing device as defined in claim 2 wherein said second sliding surface portion directs the lacing cord into said first sliding surface portion when the lacing cord is put under tension.

4. A speed lacing device as defined in claim 3, wherein said first sliding surface portion is a convex surface extending across the entire width of said curved neck portion.

5. A speed lacing device as defined in claim 1, wherein said J-shaped element comprises a guidepath for guiding said strap.

6. A speed lacing device as defined in claim 1, wherein said fastening tail is adapted to be inserted between two layers of a quarter of a footwear.

7. A speed lacing device as defined in claim 6, wherein said fastening tail is thin enough to have stitches sewn through it but thick enough to be affixed to a footwear.

8. A speed lacing device as defined in claim 1, wherein said strap at least partially wraps around said curved neck portion and sandwiches said fastening tail at one end thereof.

9. A speed lacing device as defined in claim 1, wherein said J-shaped element includes a strap passageway through which said strap passes in order to complete a loop.

10. An article of footwear comprising:

(a) an upper that extends upwardly from the base of the wearer's foot and comprises two quarters that are separated by an opening at the frontal part of said upper for allowing placement of the wearer's foot;

(b) a series of lacing devices that are attached in rows along an edge of each of said two quarters, said rows being positioned in pairs opposite each another, one of said lacing devices comprising:

i) a rigid J-shaped element adapted to be securely fastened to one of said quarters, said J-shaped element comprising a curved neck portion and a fastening tail that together define an almost-friction-free sliding surface, and a lacing cord in contact with said almost-friction-free sliding surface in either a state of tension or a state of relaxation;

ii) a flexible strap that combined with said J-shaped element forms a closed loop for receiving the lacing cord, said strap being adapted to be fastened to one of said quarters; and iii) said rigid J-shaped element and said strap together defining a lacing cord passageway adapted to receive the lacing cord for tightening said article of footwear around the wearer's foot.

11. An article of footwear as defined in claim 10, wherein said almost-friction-free sliding surface comprises a first sliding surface portion provided on said curved neck portion and a second sliding surface portion provided on said fastening tail.

12. An article of footwear as defined in claim 11, wherein said second sliding surface portion directs the lacing cord into said first sliding surface portion when the lacing cord is put under tension.

13. An article of footwear as defined in claim 12, wherein said first sliding surface portion is a convex surface extending across the entire width of said curved neck portion.

14. An article of footwear as defined in claim 13, wherein said J-shaped element comprises a guidepath for guiding said strap.

15. An article of footwear as defined in claim 14, wherein said fastening tail is adapted to be inserted between two layers of said quarter of said footwear upper.

16. An article of footwear as defined in claim 15, wherein said fastening tail is thin enough to have stitches sewn through it but thick enough to be affixed to said footwear upper.

17. An article of footwear as defined in claim 16, wherein said J-shaped element includes a strap passageway through which said strap passes in order to complete a loop.

18. An article of footwear as defined in claim 17, wherein said strap at least partially wraps around said curved neck portion and sandwiches said fastening tail at one end thereof.

19. A speed lacing device comprising:

(a) a J-shaped element comprising a curved neck portion and a fastening tail, said fastening tail being adapted to be fastened to a quarter of a footwear; and (b) a strap extending around said J-shaped element for forming therewith a closed loop for receiving a lacing cord, said strap being adapted to at least partially sandwich said fastening tail and be fastened to a quarter of a footwear.

20. A speed lacing device as defined in claim 19, wherein said curved neck portion comprises a convex surface defining a first sliding surface portion and said fastening tail comprises a second sliding surface portion, said first and second surface portions defining together an almost-friction-free sliding surface for the lacing cord.

21. A speed lacing device as defined in claim 20 wherein said second sliding surface portion directs the lacing cord into said first sliding surface portion when the lacing cord is put under tension.

22. A speed lacing device as defined in claim 21, wherein said convex surface extends across the entire width of said curved neck portion.

23. A speed lacing device as defined in claim 22, wherein said J-shaped element comprises a guidepath for guiding said strap.

24. A speed lacing device as defined in claim 23, wherein said fastening tail is adapted to be inserted between two layers of a quarter of a footwear.

25. A speed lacing device as defined in claim 24, wherein said fastening tail is thin enough to have stitches sewn through it but thick enough to be affixed to a footwear.

26. A speed lacing device as defined in claim 25, wherein said strap at least partially wraps around said curved neck portion and sandwiches said fastening tail at one end thereof.

27. A speed lacing device as defined in claim 26, wherein said J-shaped element includes a strap passageway through which said strap passes in order to complete a loop.

28. A speed lacing device comprising:

(a) a rigid portion comprising a curved neck and a fastening tail that together define an almost-friction-free sliding surface for a lacing cord that is in contact with said almost-friction-free sliding surface in either a state of tension or a state of relaxation; and (b) a flexible portion that extends from the rigid portion to form an upper half of a closed loop for receiving the lacing cord, said flexible portion being adapted to lie directly on top of said fastening tail at a point where said fastening tail and said flexible portion are securely fastened to a footwear, said fastening tail and said flexible portion together being thin enough to have stitches sewn through, but thick enough to be affixed to a footwear.

29. A speed lacing device comprising:

(a) a J-shaped element having a curved neck portion and a fastening tail that together define a sliding surface for a lacing cord, said curved neck portion comprising a back portion with a guidepath; and (b) a strap forming with said J-shaped element a closed loop for receiving the lacing cord, said strap contacting said guidepath.

30. A speed lacing device as defined in claim 29 wherein said curved neck portion further comprises a passageway for receiving said strap.

31. A speed lacing device as defined in claim 30 wherein said sliding surface comprises a first surface portion provided on said curved neck portion and a second surface portion provided on said fastening tail.

32. A speed lacing device as defined in claim 31 wherein said second surface portion of said fastening tail directs the lacing cord into said first surface portion of said curved neck portion when the lacing cord is put under tension.

33. A speed lacing device as defined in claim 32, wherein said first surface portion is a convex surface extending across the entire width of said curved neck portion.

34. A speed lacing device as defined in claim 29, wherein said fastening tail is insertable between two layers of a footwear.

35. A speed lacing device as defined in claim 29, wherein said strap at least partially wraps around said curved neck portion and sandwiches said fastening tail at one end thereof.

36. A speed lacing device as defined in claim 29, wherein said fastening tail and said strap are thin enough to have stitches sewn through them but thick enough to be affixed to a footwear.

* * * * *